US007712153B2

(12) United States Patent
Adams, Jr.

(10) Patent No.: US 7,712,153 B2
(45) Date of Patent: May 11, 2010

(54) FINGERTIP FLEXOR GLOVE

(76) Inventor: Merle Harrison Adams, Jr., 306 Meagher Ave., Bozeman, MT (US) 59718

( * ) Notice: Subject to any disclaimer, the term of this patent is extended or adjusted under 35 U.S.C. 154(b) by 0 days.

(21) Appl. No.: 11/741,957

(22) Filed: Apr. 30, 2007

(65) Prior Publication Data

US 2007/0199131 A1 Aug. 30, 2007

Related U.S. Application Data

(63) Continuation-in-part of application No. 11/160,968, filed on Jul. 18, 2005, now Pat. No. 7,210,172.

(51) Int. Cl.
*A41D 19/00* (2006.01)

(52) U.S. Cl. ..... 2/163

(58) Field of Classification Search ..... 2/16, 2/20, 21, 160, 161.1, 161.6, 163; 602/21, 602/22; 482/44, 47, 48
See application file for complete search history.

(56) References Cited

U.S. PATENT DOCUMENTS

| | | | | | |
|---|---|---|---|---|---|
| 474,929 | A | | 5/1892 | Tabor et al. | |
| 1,863,960 | A | * | 6/1932 | Aronson | 2/21 |
| 3,164,841 | A | * | 1/1965 | Burtoff | 2/21 |
| 3,224,012 | A | | 12/1965 | Hamm | |
| 3,290,695 | A | * | 12/1966 | Burtoff | 2/161.8 |
| 3,386,104 | A | * | 6/1968 | Casey | 2/16 |
| 4,766,612 | A | * | 8/1988 | Patton, Sr. | 2/16 |
| 4,781,178 | A | * | 11/1988 | Gordon | 602/22 |
| 4,995,119 | A | * | 2/1991 | Codkind | 2/161.7 |
| 5,295,948 | A | * | 3/1994 | Gray | 602/5 |
| 5,476,439 | A | | 12/1995 | Robinson | |
| 5,604,933 | A | | 2/1997 | Stephens | |
| 5,706,521 | A | | 1/1998 | Haney | |
| 6,010,473 | A | | 1/2000 | Robinson | |
| 6,049,910 | A | * | 4/2000 | McCarter | 2/161.1 |
| 6,475,174 | B1 | | 11/2002 | Chow | |
| 6,539,550 | B1 | | 4/2003 | Flores | |

FOREIGN PATENT DOCUMENTS

WO WO2004/021936 * 3/2004

* cited by examiner

*Primary Examiner*—Katherine Moran
(74) *Attorney, Agent, or Firm*—Head, Johnson & Kachigian, P.C.

(57) ABSTRACT

A novel glove for strengthening and conditioning the wearer's digits and related musculature, with an emphasis on the distal-interphlangeal joints. The glove provides a means for increasing resistance at, or alternatively prohibiting the flexion of, specific joints. Said means include annular rigid bands connected by elastic bands to a partial glove body, integral semicircular members that fit about the desired joints, and integral cylindrical members that fit about the desired joints. The exercises facilitated by the glove improve an athlete's ability to grasp an item, such as a ball, bat or an opponent. It will be appreciated that improved strength in the digits has a direct correlation with improved performance in a multitude of athletic endeavors.

6 Claims, 4 Drawing Sheets

FIG. 4
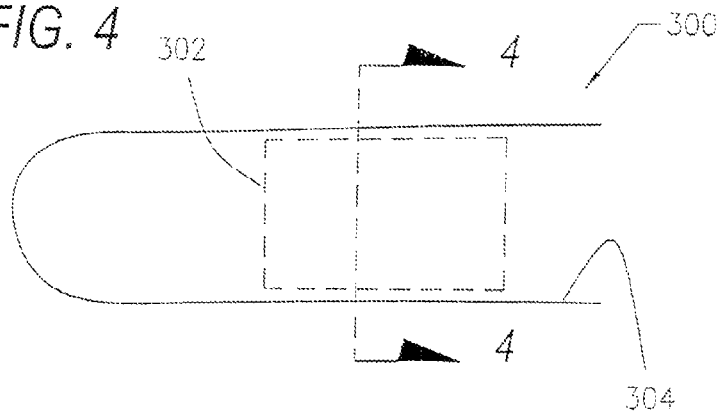
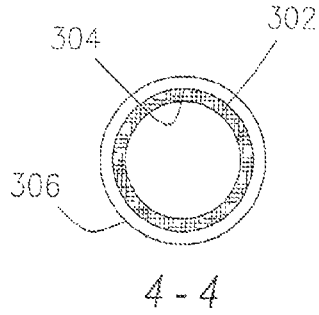
FIG. 5
FIG. 6
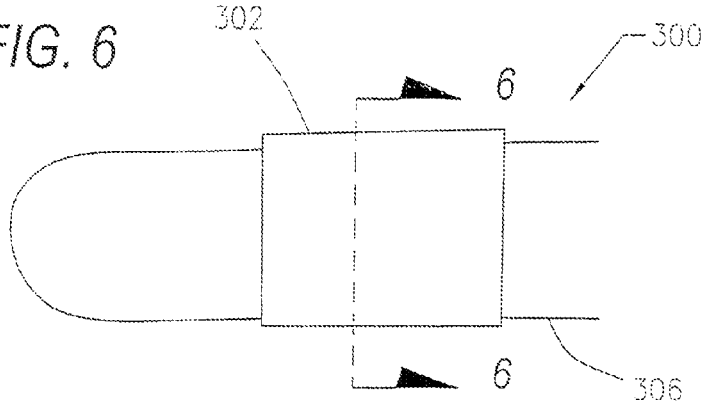
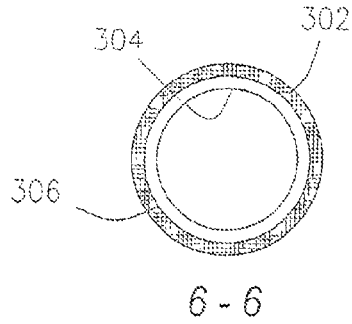
FIG. 7
FIG. 8
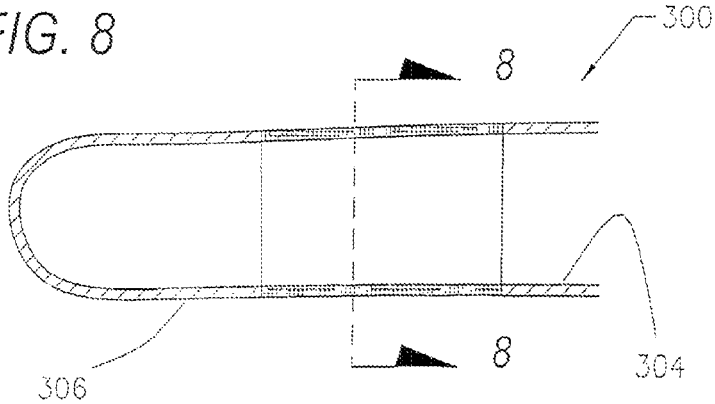
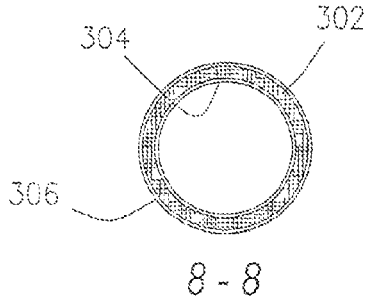
FIG. 9

FINGERTIP FLEXOR GLOVE

CROSS-REFERENCE

This application is a continuation-in-part patent application of U.S. patent application Ser. No. 11/160,968 filed Jul. 18, 2005, incorporated in its entirety herein by reference, now U.S. Pat. No. 7,210,172.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

1. Field of the Invention

The present invention relates to an exercise device for strengthening the most distal phalanges, the digits. Specifically, the exercise device allows the wearer to isolate and strengthen one or more individual muscles that control the digits.

2. Prior Art

Sports at all levels are highly competitive. Athletes are constantly practicing and exercising to improve their ability in a particular sport. Countless exercise devices have been designed to isolate and improve the strength of various muscle groups and individual muscles. While a considerable amount of attention is paid the larger muscle groups of the legs, arms and trunk, relatively little attention has been given to exercising various muscles that give strength to the fingers. This is somewhat surprising considering that most sports require the handling of a ball or other instrument in which a strong grip is important. The most important part of an athlete's grip lies in the digits, the most distal phalanges of the fingers. The ends of the fingers are vital for gripping a basketball, football and many other sport objects. While many gloved devices have been designed, none allow the wearer to focus on strengthening his or her digits.

U.S. Pat. No. 3,224,012 to Hamm teaches a bowling device "which maintains the spacing [between the fingers] so that these fingers do not wander over the surface of the bowling ball during the throwing cycle" (Col 1, Lines 20-24). More importantly, the Hamm device does not feature any structure or covering or means of restricting the two middle fingers or thumb. Whereas the instant invention is an exercise device, Hamm is essentially a substitute for muscle development.

U.S. Pat. No. 5,604,933 to Stephens discloses a flexible hand and wrist restraint to be used ostensibly for restraining a patient from moving his or her arms generally but does not teach the restriction of movement of specific anatomical features of the wearer's hand, let alone one or more of the metacarpal-phalangeal or proximal interphalangeal joints.

U.S. Pat. No. 6,476,174 to Chow discloses a sleeve having a splint to partially immobilize the thumb side of a hand and further suggests the immobilization of the wrist and "first dorsal compartment" of the wearer's hand, but it does not teach the restriction of movement of any of the digits nor does it provide a fulcrum for the digits.

U.S. Pat. No. 6,010,473 to Robinson discloses a remedial hand wear article comprising a glove for comfortably fitting onto a hand of an individual, an enclosure superimposed on a top side of the glove and permanently attached thereto, and a substantially rigid member positioned within the enclosure and operably associated with a finger of the individual to position that finger in a desired posture. The glove portion of the hand wear article provides comfort to the user while also serving to lessen the noticeability of any hand or finger grotesqueness. A proximal knuckle of at least one finger is blocked to prevent hyperextension, while the proximal knuckle and the distal knuckles of the finger are capable of full anatomical finger flexure.

It is therefore desirable to provide a device for exercising the most distal phalanges, or digits.

It is also desirable to provide a device for isolating and flexing only the digits while maintaining the rest of the hand in a stationary position.

Independent small muscle response in the hand is important to develop for many activities including sports. While the improvements in strength and flexibility are obvious, the benefits of improved independent muscle response are sometimes less recognized. Independent muscle control in the fingers is not as apparent but is even more significant in a broader sense. This applied to athletics but also goes beyond athletics to music, such as a guitar for instance, or even the workplace, such as typing. The present invention permits hand exercises and development which are designed to overcome the natural grasping reflex in the fingers. The natural grasping reflex is actually reinforced by most strength or conditioning devices, often to the detriment of muscle coordination in the hands and arms. For example, golf instructors have long recognized benefits gained by reduction of tension in the golf swing. Reducing muscle tension increases stamina and improves coordination. It is a well established principle in golf that you should grip the club with the fingers as much as possible as opposed to what might be termed a "hammer" grip. The primary benefit of the golf grip is that it eases tension in the larger muscle groups which greatly increases wrist action and consequently the power and speed in the swing. This same principle translates to throwing a football, wherein more action equates to more power and additionally quicker release. In baseball, the father out in the fingers the ball is held, the better the wrist action and the faster and hotter the fastball. In order to demonstrate this principle, one can relax the hand, fingers extended and flex the wrist. Trying tighter and tighter grips while flexing the wrist shows that a noticeable difference in the wrist movement. The improved movement is the results of reduced muscle tension in the non-involved muscles.

The present invention extends the exercises that are possible to condition the independent muscle response beyond just the distal interphalangeal joints and the exercises condition these muscles to respond more effectively in various circumstances.

SUMMARY OF THE INVENTION

Disclosed herein is a novel glove for strengthening and conditioning the wearer's digits and related musculature, with an emphasis on the distal-interphalangeal joints. The glove provides increased resistance at, or alternatively prohibits the flexion of, specific joints. The exercises facilitated by the glove improve an athlete's ability to grasp an item, such as a ball, bat or an opponent. It will be appreciated that improved strength in the digits has a direct correlation with improved performance in a multitude of athletic endeavors.

BRIEF DESCRIPTION OF THE DRAWINGS

FIG. 4 is a side view of an alternate embodiment of the invention;

FIG. 5 is a cross-section of FIG. 4 along line 4-4;

FIG. 6 is a side view of an alternate embodiment of the invention;

FIG. 7 is a cross-section of FIG. 6 along line 6-6;

FIG. 8 is a side view of an alternate embodiment of the invention; and

FIG. 9 is a cross-section of FIG. 8 along line 8-8.

DETAILED DESCRIPTION OF THE PREFERRED EMBODIMENTS

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The disclosed glove is designed to increase the flexibility and strength of the distal interphalangeal joints (DIP) of the index to the little finger.

By restricting an athlete's use of his or her hand to flexion of the DIP joint, the invention strengthens the flexor digitorum profundus muscle and teaches the athlete to rely more heavily on the strength and flexion of the DIP joint. This results in the athlete's improved ability to catch, handle, hold and otherwise manipulate a ball or other instrument.

Figure 1:
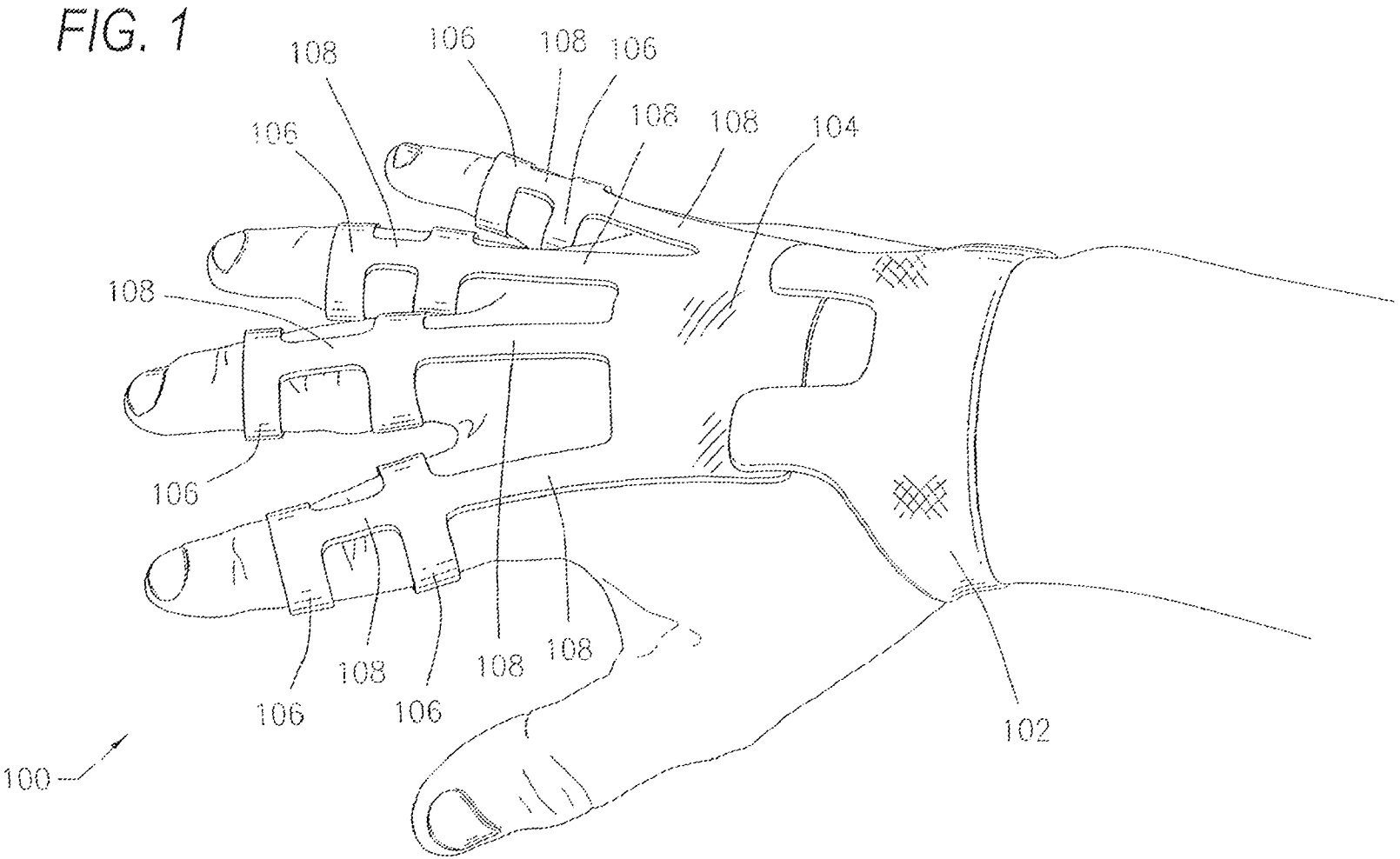
FIG. 1 shows a top plan view of the invention.

FIG. 1 depicts one embodiment of the present invention. Device 100 is designed such that it may be used by itself or may be worn underneath a normal, flexible glove. It includes a rigid or elastic wrist band 102 to hold device 100 in place about the wearer's hand. Device 100 also includes a smaller body 104 that only partially covers the top of the wearer's hand. Annular, rigid bands 106 hold device 100 firmly in place upon one or more of the wearer's fingers. Rigid bands 106 are located between the joints of the fingers, and are connected by elastic bands 108. Those skilled in the art will appreciate that device 100 provides resistance to the flexion of all of the phalangeal joints, but especially causes the wearer to most utilize and strengthen the DIP joints.

Figure 2:
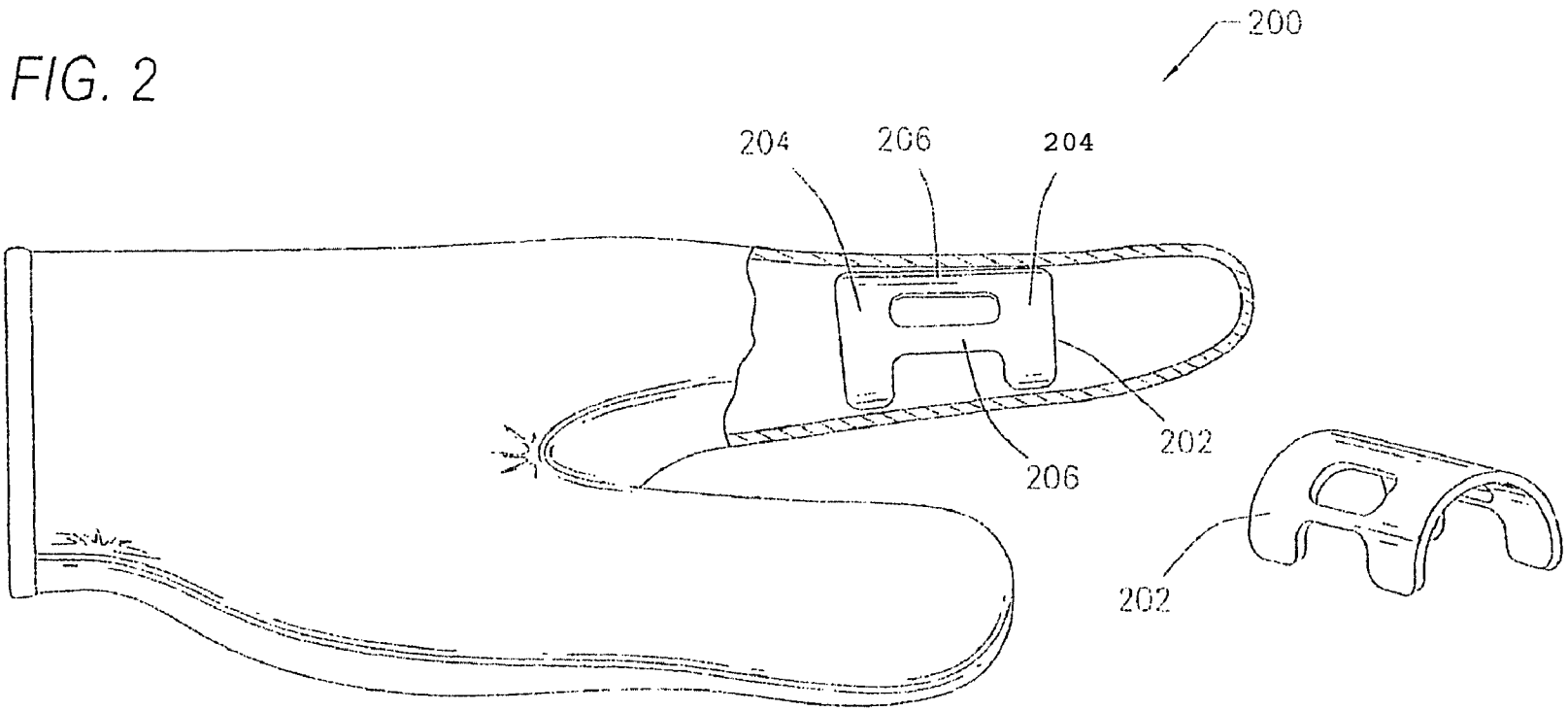
FIG. 2 shows a side view of an alternate embodiment of the invention.

An alternate embodiment of the disclosed invention is shown in FIG. 2. One or more open, semi-circular resistance members 202 are disposed within a glove 200. Glove 200 may be any suitable flexible glove. Resistance members 202 comprise rigid bands 204 that wrap partially around the wearer's finger. Rigid bands 204 are connected to one another by one or more elastic bands 206. In this embodiment, resistance is provided to the flexion of the joint about which resistance member 202 is situated.

Figure 3:
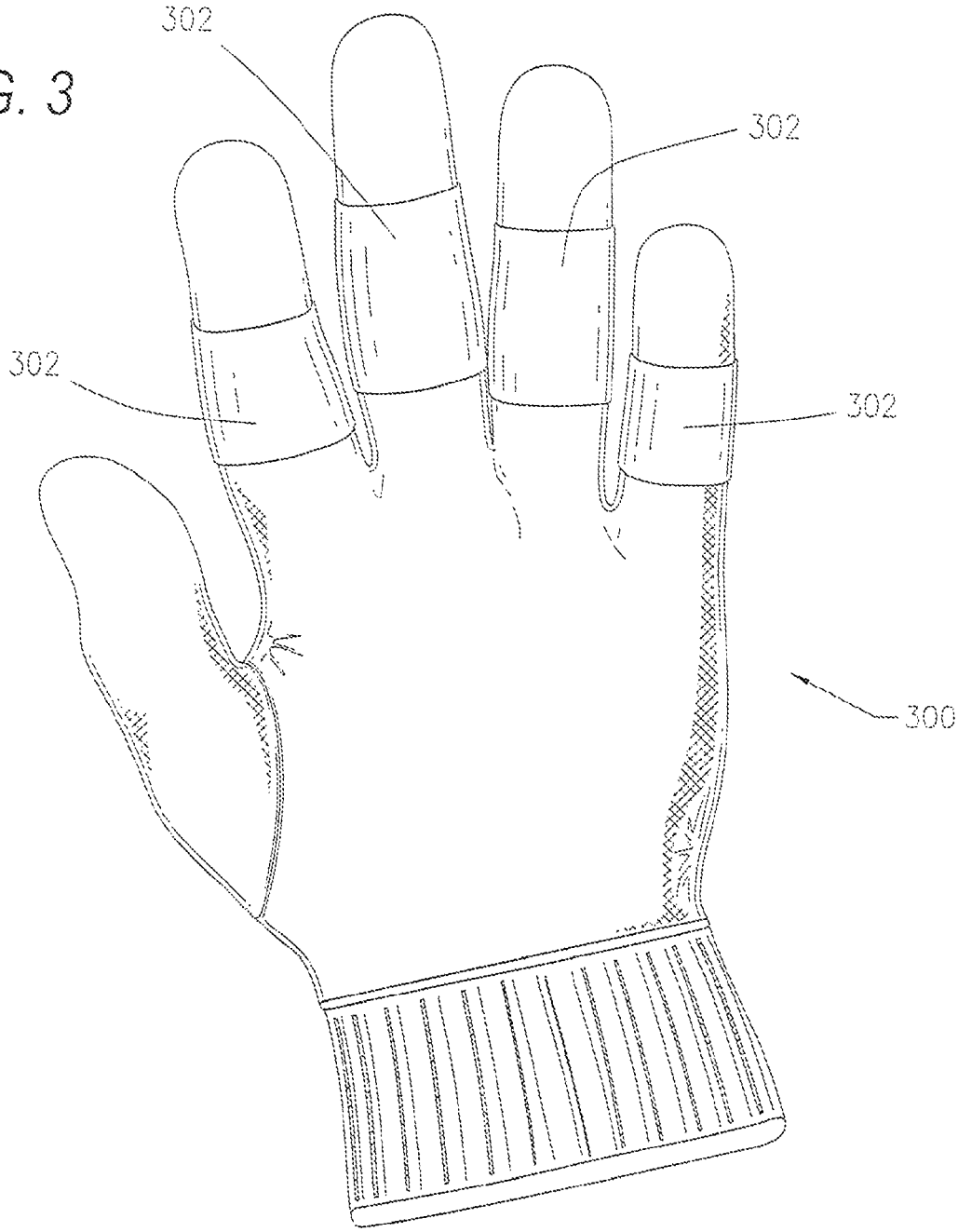
FIG. 3 depicts yet another alternate embodiment of the invention.

Yet another alternate embodiment of the disclosed invention is depicted in FIG. 3. Glove 300 may be any commercially available flexible glove, but is preferably a close-fitting, full-body soft glove made of soft leather, fabric or similar material. Open, cylindrical resistance members 302 are spaced about the fingers of glove 300 such that the members begin distal from the wearer's metacarpal phalangeal joint (MP) and terminate short of the wearer's DIPs. As a result, the wearer's proximal interphalangeal joint (PIP) is immobilized, but flexion at both the MP and DIP is permitted. Resistance members 302 are cylindrical or tube-like, and may be constructed of any solid material, including wood, plastics, metals, PVC, etc.

Persons skilled in the art will appreciate that the distance between joints will vary between individuals. The disclosed invention is practiced such that gloves will be manufactured in a variety of sizes, such as small, medium, large and extra large, and that while it may not be possible to account for all anatomical variations, measurements may be taken that will reasonably enable the invention to be practiced on an overwhelming majority of wearers.

As shown in FIGS. 4 and 5, resistance members 302 may be situated on the inside of the fingers of glove 300, contiguous with the internal fabric lining 304 of glove 300. FIG. 5 is a cross-section of FIG. 4 along line 4-4. FIGS. 6 and 7 demonstrate resistance member 302 on the outside of the fingers of glove 300, contiguous with the exterior fabric surface 306 of glove 300. FIG. 7 is a cross-section of FIG. 6 along line 6-6. FIGS. 8 and 9 shows resistance member 302 disposed between the internal fabric lining 304 and exterior fabric surface 306 of glove 300. FIG. 9 is a cross-section of FIG. 8 along line 8-8. The embodiment depicted in FIGS. 8 and 9 may be open (i.e., unclosed pouch into which resistance member 302 is inserted and removed, covered by a flap) or closed. Resistance members 302 may be sewn, attached, glued or otherwise affixed to glove 300.

It should be noted that semi-circular resistance members 202, as shown in FIG. 2, could also be disposed within the glove in the same fashion as resistance members 302 as depicted in FIGS. 4-9.

Whereas, the present invention has been described in relation to the drawings attached hereto, it should be understood that other and further modifications, apart from those shown or suggested herein, may be made within the spirit and scope of this invention.

What is claimed is:

1. An apparatus for increasing flexibility and strength of the distal interphalangeal joints comprising:

a soft, full-body glove having four fingers wherein said glove further comprises an internal fabric lining and an exterior fabric surface; and one or more open cylindrical rigid resistance members situated about the fingers of said glove, wherein said resistance members begin distal from the portion of said fingers approximating a wearer's metacarpal phalangeal joint and terminate short of the portion of said fingers approximating the wearer's distal interphalangeal joint, such that said one or more resistance members span the wearer's proximal interphalangeal joint and immobilize the wearer's proximal interphalangeal joint, and wherein said cylindrical members are contiguous with the internal fabric lining of said fingers.

2. The apparatus of claim 1 further comprising one cylindrical resistance member situated about each of the four fingers of said glove.

3. The apparatus of claim 1 wherein said cylindrical resistance members are attached to said fingers of said glove using an attachment means selected from the group consisting of sewn into place and glued into place.

4. An apparatus for increasing flexibility and strength of the distal interphalangeal joints comprising:

a soft, full-body glove having four fingers wherein said glove further comprises an internal fabric lining and an exterior fabric surface; and one or more open cylindrical rigid resistance members situated about the fingers of said glove, wherein said resistance members begin distal from the portion of said fingers approximating a wearer's metacarpal phalangeal joint and terminate short of the portion of said fingers approximating the wearer's distal interphalangeal joint, such that said one or more resistance members span the wearer's proximal interphalangeal joint and immobilize the wearer's proximal interphalangeal joint, and wherein said cylindrical members are contiguous with the exterior fabric surface of said glove.

5. The apparatus of claim 4 further comprising one cylindrical resistance member situated about each of the four fingers of said glove.

6. The apparatus of claim 5 wherein said cylindrical resistance members are attached to said fingers of said glove using an attachment means selected from the group consisting of sewn into place and glued into place.

* * * * *